US007291006B2

(12) United States Patent
Ilmonen

(10) Patent No.: US 7,291,006 B2
(45) Date of Patent: Nov. 6, 2007

(54) CHECK VALVE LIP SEAL FOR AN INJECTION MOLDING MACHINE

(75) Inventor: Robert Ilmonen, Mississauga (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 423 days.

(21) Appl. No.: 10/875,047

(22) Filed: Jun. 24, 2004

(65) Prior Publication Data

US 2005/0284600 A1 Dec. 29, 2005

(51) Int. Cl.
*B29C 45/00* (2006.01)
*F16K 15/00* (2006.01)

(52) U.S. Cl. ..... 425/562; 137/528

(58) Field of Classification Search ..... 137/528, 137/533.27; 425/146, 562, 563, 564
See application file for complete search history.

(56) References Cited

U.S. PATENT DOCUMENTS 2,742,333 A 4/1956 Taylor
3,726,309 A * 4/1973 Neubert ..... 137/528
4,231,578 A 11/1980 Traub
4,743,033 A 5/1988 Guess
4,966,539 A 10/1990 Pena
5,040,589 A 8/1991 Bradley et al.
5,221,509 A 6/1993 Fujimoto et al.
5,427,514 A * 6/1995 Horibe et al. ..... 425/3
5,441,400 A * 8/1995 Zeiger ..... 425/562
5,507,505 A 4/1996 von-Arndt et al.
5,865,442 A 2/1999 Iwashita
6,029,979 A 2/2000 Grosspietsch et al.
6,435,201 B2 * 8/2002 Holzschuh ..... 137/1
6,494,703 B2 12/2002 Kestle et al.
6,585,001 B2 * 7/2003 Gatti ..... 137/533.27
6,857,867 B2 * 2/2005 Schimmel ..... 425/559

* cited by examiner

*Primary Examiner*—Kevin P. Kerns

(57) ABSTRACT

A check valve for a molding machine. The check valve has a stem portion and a ring portion movable along said stem portion between a melt channel open position and a melt channel closed position. A groove is formed in a forward face of the ring portion. The groove, in operation, receives melt to force an outer circumferential portion of the ring in a radial direction to provide a seal between the ring portion and a wall in the machine.

5 Claims, 5 Drawing Sheets

CHECK VALVE LIP SEAL FOR AN INJECTION MOLDING MACHINE

BACKGROUND OF INVENTION

1. Field of the Invention

The present invention relates, generally, to a check valve for a metal injection molding machine or die casting machine, and more particularly, but not exclusively, the invention relates to a seal for such a valve and particularly a lip seal for such a valve.

2. Background Information

The state of the art includes many check valves for both plastic and metal injection molding machines. While many of these check valves work satisfactorily in the plastics environment, most do not work well in the metal injection environment. Plastic is quite viscous and does not tend to flow through small gaps. Molten metals are much hotter and have a much lower viscosity so that any tolerable gap must be much smaller than an acceptable gap for plastic molding. This requires much tighter tolerances for metal molding. Up to the present time, no satisfactory seal for a check valve for metal molding has been developed. The check valves in current use do not satisfactorily meet the dual requirements of very low bypass leakage and the ability to withstand operating within an environment that imparts extremely harsh mechanical loading, chemical reactivity and high temperature. The check valves currently used have a very short operational life and must be replaced often leading to substantial disruption of the molding or casting process and reduction in the production of satisfactory parts.

The following patent references are representative of sealing alternatives currently available.

U.S. Pat. No. 5,865,442 issued Feb. 2, 1999 to Iwashita describes a piston seal formed upon one side of a piston body. The piston body has a tapered surface receiving a back portion of the seal. The front portion has a lip. The seal is compressed against the wall of the cylinder by the combined forces applied by the tapered surface and oil pressure on the lip portion. The seal is vulcanized adhered to the piston.

U.S. Pat. No. 2,742,333 issued Apr. 17,1956 to Taylor et al describes a plastic seal that is molded into a groove on a piston. The seal has a lip portion that is forced into tight sealing contact with a bore of the cylinder by action of an O-ring positioned on the piston.

U.S. Pat. No. 4,231,578 issued Nov. 4, 1980 to Traub describes a sealing assembly for sealing a shaft. The seal comprises a first sealing ring having a Y-shaped cross-sectional configuration and a second sealing ring having a generally L-shaped cross-sectional configuration. The two rings interface along the L-shaped portion. The. Y-shaped seal is made of rubber and the L-shaped ring of polytetrafluorethylene.

U.S. Pat. No. 4,743,033 issued May 10, 1988 describes a seal assembly for subterranean wells. A first non-elastomeric sealing element has a hub portion secured to the piston and an outwardly flaring skirt portion searingly engage able with the cylinder bore. A secondary sealing element of resilient metal is secured to the piston and defines a frusto-conical lip portion that snugly engages the skirt portion of the first element.

U.S. Pat. No. 5,507,505 issued Apr. 16, 1996 to Stein et al describes a lip seal that has a series of concentric grooves formed in the surface of the lip contacting the wall of a polymeric body.

While each of these references teaches the use of lip seals in a particular environment, none of them would be capable of withstanding the heat, pressure and corrosiveness involved in molding metal parts. It is even doubtful that any of them could operate satisfactorily in a plastic injection molding machine environment.

There is a need for a check valve in metal injection molding and die casting that is durable and can withstand the high temperatures, injection pressures and corrosive environment and effectively seals the injection channel to prevent the backflow of the molten metal into the supply cylinder during the injection stroke. None of the above referenced patents describe a check valve seal nor a sealing device that could be modified to effectively seal such a check valve during injection of metal into a mold.

SUMMARY OF INVENTION

The present invention provides an improved seal for an injection molding or die casting machine and, more particularly, a lip seal for a check ring of a check valve for a metal injection machine.

In particular, the invention provides a seal for a check valve of a molding machine that comprises a ring having a rear surface engageable with a surface of the valve to block flow of injection material into an melt passageway and a groove interior of a circumferential surface of the ring. The groove extends rearwardly from a forward surface of the valve.

The invention also provides a check valve for a molding machine. The check valve has a stem portion and a ring portion movable along the stem portion between a melt channel open position and a melt channel closed position. A groove is formed in a forward face of the ring portion. The groove, in operation, receives melt to force an outer circumferential portion of the ring in a radial direction to provide a seal between the ring portion and a wall in the machine.

BRIEF DESCRIPTION OF DRAWINGS

Exemplary embodiments of the present invention will now be described with reference to the accompanying drawings, in which.

DETAILED DESCRIPTION

The structure and operation of the present invention will be explained, hereinafter, within the context of improving the function and durability of a check valve that is configured for use in a barrel assembly of an injection molding system for the molding of a metal alloy, such as those of Magnesium, in a semi-solid (i.e. thixotropic) state. A detailed description of the construction and operation of several of such injection molding systems is available with reference to U.S. Pat. Nos. 5,040,589 and 6,494,703. Notwithstanding the foregoing, no such limitation on the general utility of the check valve of the present invention is intended, or its compatibility with other metal alloys (e.g. Aluminum, Zinc, etc.).

Figure 1:
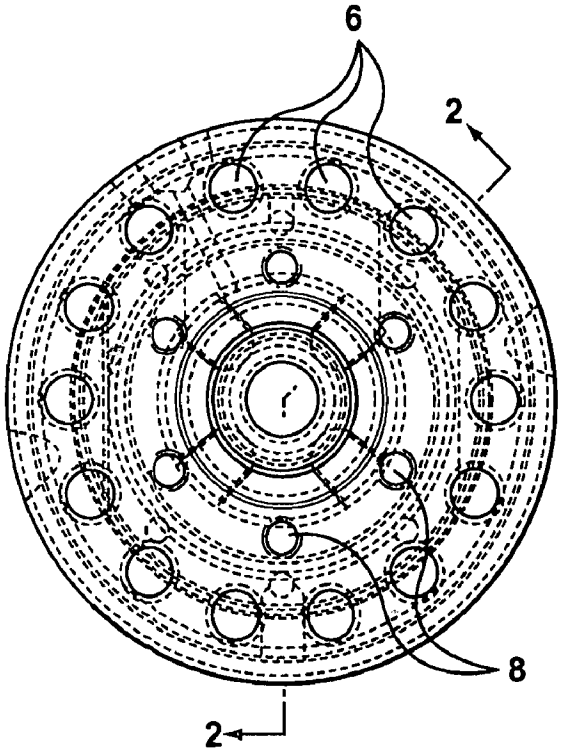
FIG. 1 is an end view of an injection barrel of a metal injection molding machine.
Figure 1A:
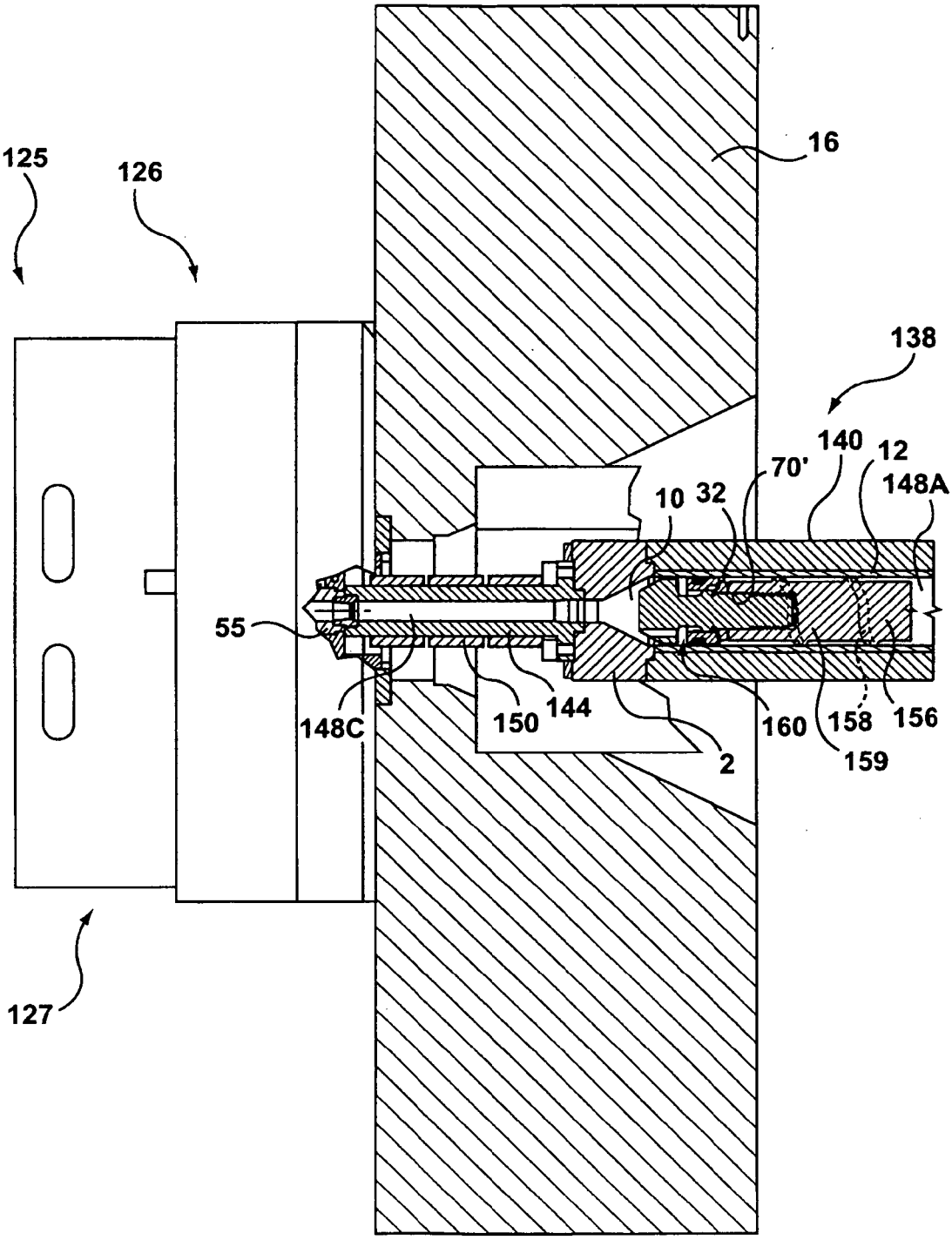
FIG. 1A (PRIOR ART)
FIG. 1A is a cross sectional view of a prior art barrel assembly for an injection molding machine.

The barrel assembly of a prior art injection molding system is shown with reference to FIG. 1A.

The barrel assembly 138 is shown to include an elongate cylindrical barrel 140 with an axial cylindrical bore 148A arranged therethrough. The barrel assembly is shown connected to a stationary platen 16 of a clamping unit (not otherwise shown). The bore 148A is configured to cooperate with the screw 156 arranged therein, for processing and transporting metal feedstock, and as a means for accumulating and subsequently channeling a melt of molding material during injection thereof. The screw 156 includes a helical flight 158 arranged about an elongate cylindrical body portion 159. A rear portion of the screw, not shown, is configured for coupling with a drive assembly, not shown, and a forward portion of the screw 156 is configured for receiving a check valve 160. An operative portion of the check valve 160 is arranged in front of a forward mating face or shoulder 32 of the screw 156. The barrel assembly 138 includes a barrel head 2 that is positioned intermediate the machine nozzle 144 and a front end of the barrel 140. The barrel head 2 includes a melt passageway 10 arranged therethrough that connects the barrel bore 148A with a complementary melt passageway 148C arranged through the machine nozzle 144. The melt passageway 10 through the barrel head 2 includes an inwardly tapering portion to transition the diameter of the melt passageway to the much narrower melt passageway 148C of the machine nozzle 144. The central bore 148A of the barrel 140 includes a lining 12 made from a corrosion resistant material, such as Stellite™, to protect the barrel substrate material, commonly made from a nickel-based alloy such as Inconel™, from the corrosive properties of the high temperature metal melt. Other portions of the barrel assembly 138 that come into contact with the melt of molding material may also include similar protective linings or coatings. The barrel 140 is further configured for connection with a source of comminuted metal feedstock through a feed throat, not shown, that is located through a top-rear portion of the barrel 140, not shown. The feed throat directs the feedstock into the bore 148A of the barrel 140. The feedstock is then subsequently processed into molding material by the mechanical working thereof, by the action of the screw 156 in cooperation with the barrel bore 148A, and by controlled heating thereof. The heat is provided by a series of heaters, not shown, that are arranged along a substantial portion of the length of the barrel assembly 138 and heaters 150 along machine nozzle 144.

The injection mold includes at least one molding cavity, not shown, formed in close cooperation between complementary molding inserts shared between a mold cold half, not shown, and a mold hot half 125. The mold cold half includes a core plate assembly with at least one core molding insert arranged therein. The mold hot half 125 includes a cavity plate assembly 127, with the at least one complementary cavity molding insert arranged therein, mounted to a face of a runner system 126. The runner system 126 provides a means for connecting the melt passageway 148C of the machine nozzle 144 with the at least one molding cavity for the filling thereof. As is commonly known, the runner system 126 may be an offset or multi-drop hot runner, a cold runner, a cold sprue, or any other commonly known melt distribution means. In operation, the core and cavity molding inserts cooperate, in a mold closed and clamped position, to form at least one mold cavity for receiving and shaping the melt of molding material received from the runner system 126.

In operation, the machine nozzle 144 of the barrel assembly 138 is engaged in a sprue bushing 55 of the injection mold whilst the melt is being injected into the mold (i.e. acts against the reaction forces generated by the injection of the melt).

The molding process generally includes the steps of:

i) establishing an inflow of metal feedstock into the rear end portion of the barrel 140;

ii) working (i.e. shearing) and heating the metal feedstock into a thixotropic melt of molding material by:

a. the operation (i.e. rotation and retraction) of the screw 156 that functions to transport the feedstock/melt, through the cooperation of the screw flights 158 with the axial bore 148A, along the length of the barrel 140, past the check valve 160, and into an accumulation region defined in front of the check valve 160;

b. heating the feedstock material as it travels along a substantial portion of the barrel assembly 138;

iii) closing and clamping of the injection mold halves;

iv) injecting the accumulated melt through the machine nozzle 144 and into the injection mold by a forward translation of the screw 156;

v) optionally filling any remaining voids in the at least molding cavity by the application of sustained injection pressure (i.e. packing);

vi) opening of the injection mold, once the molded part has solidified through the cooling of the injection mold;

vii) removal of the molded part from the injection mold; and viii)optionally conditioning of the injection mold for a subsequent molding cycle (e.g. application of mold release agent).

The steps of preparing a volume of melt for subsequent injection (i.e. steps i) and ii)) are commonly known as 'recovery', whereas the steps of filling and packing of the at least one mold cavity (i.e. steps iv) and v)) are commonly known as 'injection'.

The check valve 160 functions to allow the forward transport of melt into the accumulation region at the front of the barrel 140 but otherwise prevents the backflow thereof during the injection of the melt. The proper functioning of the check valve 160 relies on a pressure difference between the melt on either side thereof (i.e. higher behind the valve during recovery, and higher in front during injection). The structure and operation of a typical check valve, for use in metal injection molding, is described in U.S. Pat. No. 5,680,894.

Figure 2:
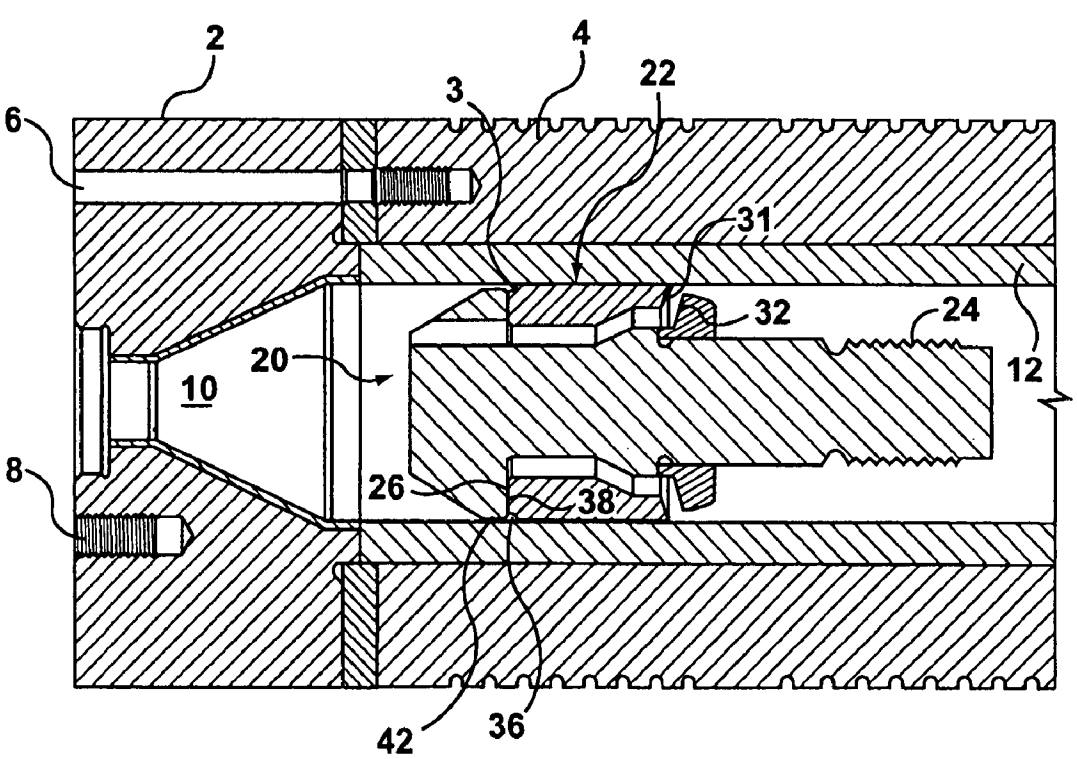
FIG. 2 is a cross sectional view along section 2-2 of FIG. 1 with a check valve in an open position.

Referring to FIGS. 1 and 2, a portion of a barrel assembly of an injection molding assembly for a metal molding machine is shown in accordance with a preferred embodiment of the present invention. FIG. 1 shows an end view of the barrel assembly while FIG. 2 shows a cross-section of the assembly including the improved seal of this invention.

Figure 3:
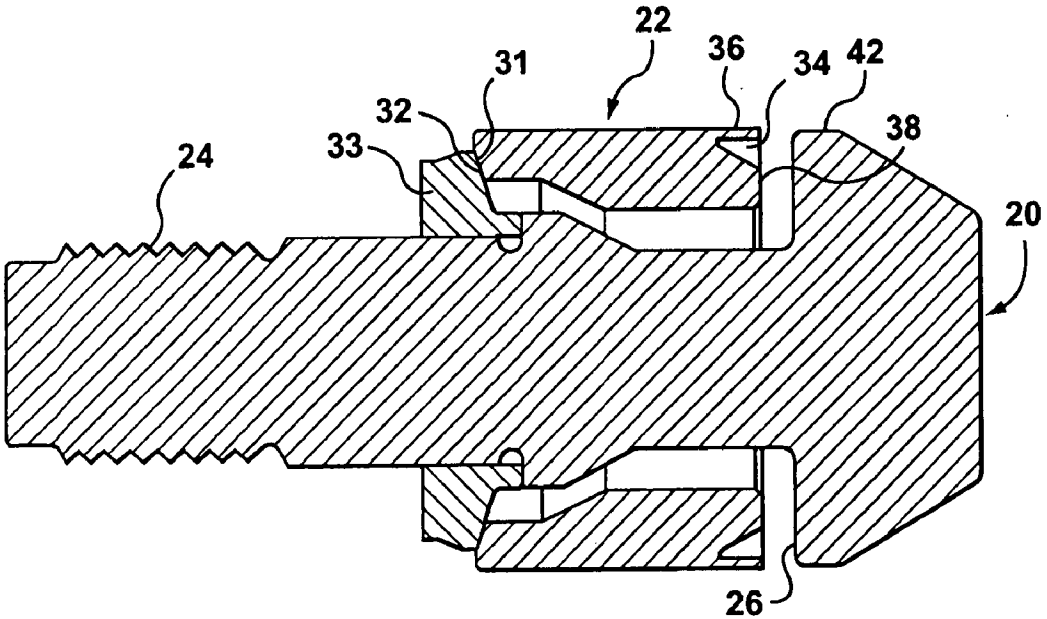
FIG. 3 is a detailed cross sectional view along section 3-3 in FIG. 4 showing the improved check valve in the closed position.

As shown in FIG. 2, a barrel head 2 is attached to barrel 4 by bolt means extending through bolt channels 6. A machine nozzle (not shown), such as the machine nozzle 144 in FIG. 1A, is attached to the barrel head 2 by means of bolts extending into bolt holes 8. The stem 20 of a check valve is attached to an injection screw such as screw 156 shown in FIG. 1A by threads 24. Check ring 22 is forced towards its open position shown by the pressure of melt provided by rotation of the screw in the channel in a manner well understood in the art. The melt flows through the passage between shoulders 31 and 32 and along the surfaces between the ring 22 and stem 20 to fill a melt passageway 10 in front of the stem 20. When sufficient melt is fed into the melt passageway 10, rotation of the screw is stopped and the melt is injected into the mold by translating the screw in a forward direction. The forward movement of the screw causes the melt to put pressure on the forward surfaces of the ring 22 to force it back to seal off the melt flow path at the shoulders 31 and 32 as shown in FIG. 3. The melt also creates a pressure in the groove 34 to force the outer extension of the groove 34 against the inner wall of the lining 12 of the barrel 4 to thereby prevent the leakage of melt into the region between the inner wall of the lining 12 and the outer wall of the ring 22.

In FIG. 3, the stem 20 of the check valve has threads 24 that engage threads on a plasticizing screw such as screw 156 to enable removal of the check valve from the screw when necessary. The check ring 22 has a first shoulder 31 that engages shoulder 32 on the check ring seat 33 when the check valve is in the closed position shown. The shoulders 31 and 32 are slightly inclined to provide a longer sealing surface, a smoother flow path and prevent back flow of melt into the barrel of the injection machine when melt is being injected into the mold. The check ring 22, the stem 20 and the barrel lining 12 are preferably made of steel that has high strength at high temperatures and pressures and does not corrode. For example, when molding magnesium, these elements must contain zero nickel content, withstand temperatures as high as 600 degrees C. and pressures as high as 129 Mpa.

The forward section of the ring 22 includes a groove or cut-out portion 34. The groove 34 creates a circumferential ring portion 36 that flexes under pressure applied by melt in the melt channel as the screw is moved forward to inject melt into a mold. The melt in groove 34 presses against the surfaces of the groove and the force of the melt forces the ring portion 36 toward the surface of the barrel lining 12 to form a seal to prevent the flow of the melt back along the wall of barrel lining 12.

By providing the slightly flexible ring portion 36, a more effective seal against leaking of very fluid melt can be prevented without requiring the very tight tolerances necessary with sealing devices previously used in metal injection molding and die casting. With this design, the pressure of the melt assists in maintaining the seal during injection whereas with previously used cylindrical seals the pressure of the melt tended to force separation between the cylindrical seal and the wall of the barrel. This pressure necessitated a very tight tolerance between the inner diameter of the barrel and the outer diameter of the check ring. This tight tolerance creates a problem of wear between the barrel and the check ring and frictional losses because of the proximity of the surfaces of the barrel and the check ring. These problems are substantially avoided by the new check ring 22 because the check ring 22 can have a slight gap between the outside of the check ring 22 and the lining 12 in the wall of the barrel since the flexure of the ring portion 36 under the pressure of the melt will maintain a seal over the slight gap.

Existing check valve designs for metal molding include splits and seams in their construction. These splits and seams permit axial leakage of the low viscosity metal melt along the barrel and other longitudinal surfaces in the flow path. This leakage is disruptive to the injection process causing unpredictable variations in shot volume and may also lead to some early mechanical failure modes of the valve, most notably, high velocity erosion of various surfaces. Our design of a simple lip seal eliminates the need to use a split or a seam and practically eliminates leakage and substantially extends the acceptable working life of the valve while also providing a highly repeatable shot volume over a long period of time.

Figure 4:
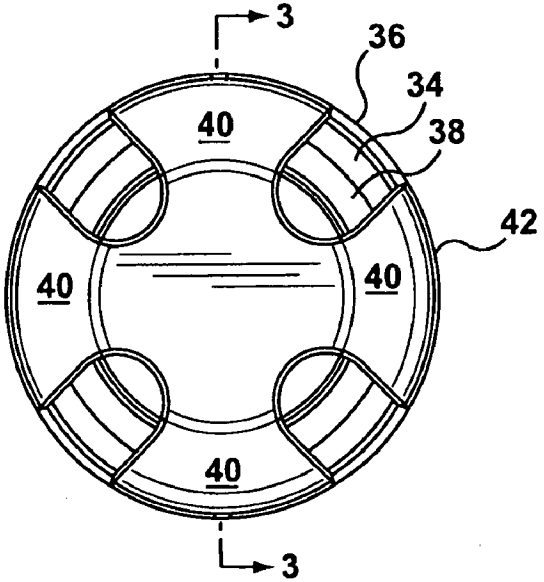
FIG. 4 is an end view of the check valve shown in FIG. 3.

As illustrated in FIG. 4, the end of stem 20 is furcated into four fingers 40 creating four zones for the melt to pass into the mold cavity when the screw (not shown) is rearwardly translated and the check valve is in the open position. The fingers 40 also provide a stop for the check ring 22 to ensure that it travels with the check valve. The outer circumference 42 of the furcated end of the stem 20 may be slightly gapped from the inner surface of the barrel to ensure that there is no dragging contact between the fingers 40 and the barrel lining 12.

Figure 5B:
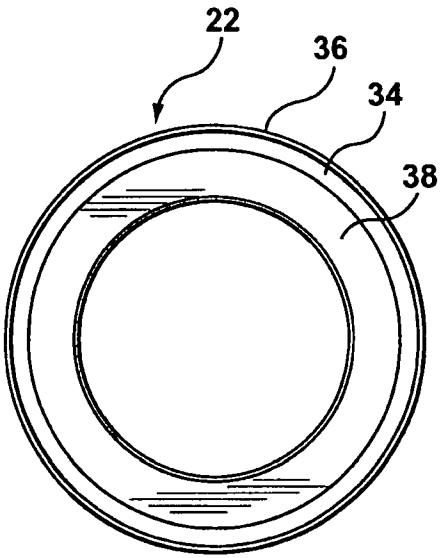
FIG. 5B is an end view of the check ring.
Figure 5A:
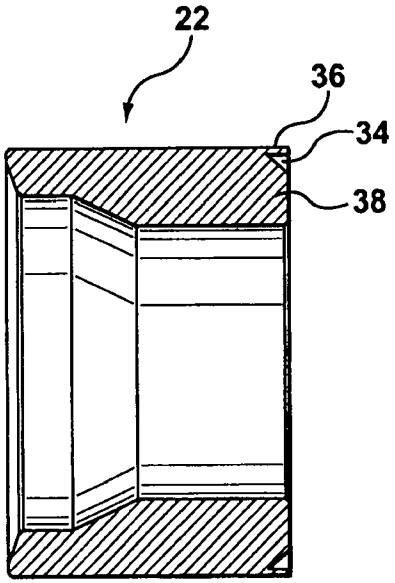
FIG. 5A is a cross sectional view of the check ring.
Figure 5:
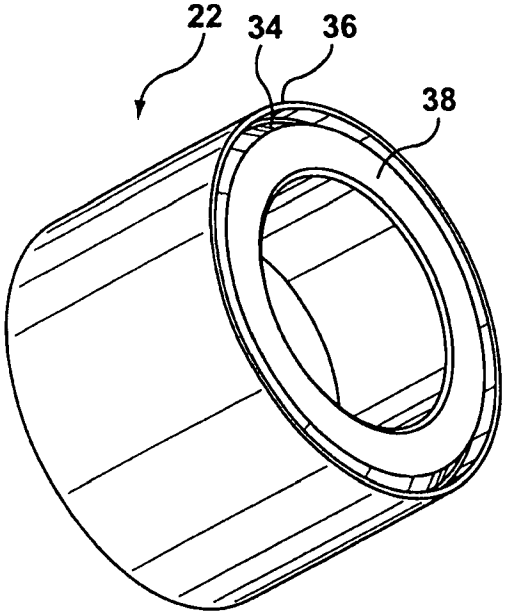
FIG. 5 is an isometric view of the check ring for sealing the check valve.

FIGS. 5. 5A and 5B illustrate the check ring 22 in detail. The inner wall 38 provides a forward stopping surface that contacts the fingers 40 when the check valve is in the open position. The outer circumference 42 provides a forward stop for the ring portion 36.

Figure 6:
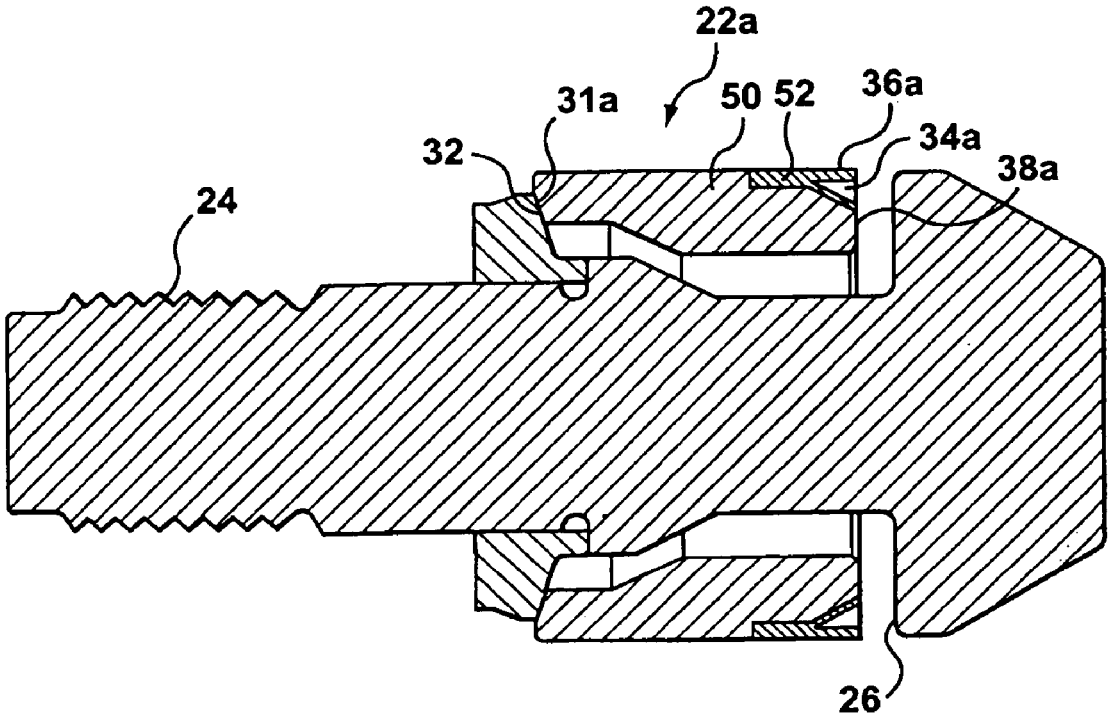
FIG. 6 is a detailed cross sectional view of a further embodiment of the improved check valve.

FIG. 6 illustrates a second embodiment of the invention. In this embodiment the check ring is formed in two parts. The main part 50 provides the outer surface of a melt flow channel through the valve and a shoulder for supporting the sealing part 52 that is either attached to the main part 50 by brazing or welding or other suitable means or can be permitted to move freely. Parts of the check ring 22*a* similar to parts of the check ring 22 have been designated by similar reference numerals with an added suffix a.

It will, of course, be understood that the above description has been given by way of example only and that modifications in detail may be made within the scope of the present invention. For example, while the invention has been described in terms of a generally V-shaped groove in the check ring, the groove could be of many other shapes such as oval or even rectangular. The significant aspect is that the groove provides a face that receives a component of force in the radial direction to move the flexible portion into sealing contact with the barrel surface.

What is claimed is:

1. A seal for a check valve of a molding machine, said seal comprising a ring having a rear surface engageable with a surface of said valve to block flow of injection material into a melt passageway and a groove interior of a circumferential surface of said ring and extending from a forward surface of said valve toward said rear surface.

2. The seal of claim 1 wherein said groove is relatively shallow with respect to the length of said ring.

3. The seal of claim 1 wherein said groove creates a relatively thin annular lip around said ring to create a thin flexible extension from said ring, said extension being flexed, in operation, by injection material to form a seal between said ring and a wall of an injection channel.

4. A seal as defined in claim 3 wherein said groove is a V-shaped groove.

5. A seal as defined in claim 3 wherein said groove is a V-shaped groove with one side of said V extending in a direction parallel to said wall to form said annular lip.

* * * * *